US008436879B2

(12) United States Patent
Sato

(10) Patent No.: US 8,436,879 B2
(45) Date of Patent: May 7, 2013

(54) THERMAL HEAD MECHANISM, PRINTING DEVICE USING THE SAME, AND METHOD OF SUPPORTING THERMAL HEAD

(75) Inventor: Katsutoshi Sato, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 321 days.

(21) Appl. No.: 12/868,464

(22) Filed: Aug. 25, 2010

(65) Prior Publication Data

US 2011/0063395 A1 Mar. 17, 2011

(30) Foreign Application Priority Data

Sep. 16, 2009 (JP) ..... 2009-214874

(51) Int. Cl.
*B41J 25/304* (2006.01)

(52) U.S. Cl.
USPC ..... 347/197

(58) Field of Classification Search ..... 347/197; 400/120.16
See application file for complete search history.

(56) References Cited

U.S. PATENT DOCUMENTS 4,641,151 A * 2/1987 Kato et al. ..... 347/197
4,750,880 A * 6/1988 Stephenson et al. ..... 400/120.16
4,962,392 A * 10/1990 Okuno et al. ..... 346/145
4,990,937 A * 2/1991 Tashiro et al. ..... 346/139 R

FOREIGN PATENT DOCUMENTS

JP 63-173654 * 7/1988 ..... 347/197
JP 09-123489 5/1997

OTHER PUBLICATIONS

Computer-generated translation of JP 09-123489, published May 1997.*

* cited by examiner

*Primary Examiner* — Huan Tran
(74) *Attorney, Agent, or Firm* — Patterson & Sheridan, LLP

(57) ABSTRACT

A printhead mechanism and printing device capable of readily achieving adequate printing pressure are provided. The printhead mechanism includes a thermal printhead supported and pressed to a paper sheet or ink ribbon moving in a predetermined conveyance direction, a pressing mechanism pressing the thermal printhead in a direction orthogonal to the conveyance direction, a head supporting mechanism supporting the thermal printhead movably in head-pressing direction, wherein an acting point P2 of a pressing-force W, at which the thermal printhead is pressed, is disposed downstream of a supporting point p3 at which the thermal printhead is supported.

17 Claims, 2 Drawing Sheets

$$\left(\begin{array}{ll} 0.7 \leqq M1/M2 \leqq 1.3 & \cdots \text{EXPRESSION 1} \\ M1 = L1 \times F' & \cdots \text{EXPRESSION 2} \\ M2 = L2 \times W' & \cdots \text{EXPRESSION 3} \\ F' = \mu W \cos\theta 1 & \cdots \text{EXPRESSION 4} \\ W' = W \cos\theta 2 & \cdots \text{EXPRESSION 5} \end{array}\right)$$

| | |
|---|---|
| $0.7 \leqq M1/M2 \leqq 1.3$ | ···EXPRESSION 1 |
| $M1 = L1 \times F'$ | ···EXPRESSION 2 |
| $M2 = L2 \times W'$ | ···EXPRESSION 3 |
| $F' = \mu W \cos \theta 1$ | ···EXPRESSION 4 |
| $W' = W \cos \theta 2$ | ···EXPRESSION 5 |

THERMAL HEAD MECHANISM, PRINTING DEVICE USING THE SAME, AND METHOD OF SUPPORTING THERMAL HEAD

CROSS REFERENCE TO THE RELATED APPLICATION

This application is based upon and claims the benefit of priority from the prior Japanese Patent Application No. 2009-214874 filed on Sep. 16, 2009, the contents of which are incorporated herein by reference.

TECHNICAL FIELD

An embodiment described herein relates to a thermal head mechanism that prints on an object that is conveyed, a printing device using the same, and a method of supporting a thermal head.

BACKGROUND

In printing devices such as a thermal printer, there is known a printing device incorporating a head-pressing mechanism that causes a printhead having lined heat elements to abut on a paper sheet conveyed in a predetermined direction by pressing the printhead in a direction orthogonal to the paper-conveyance direction. This type of printer is typically provided with a printhead mechanism having a supporting mechanism supporting the printhead so as to slidably move in the head-pressing direction to maintain an appropriate print pressure to the paper. In such printers and mechanisms, a rotational moment is produced in a pressing part by virtue of a frictional force caused between the printhead, and a paper sheet or ink ribbon.

BRIEF DESCRIPTION OF THE DRAWINGS

Aspects of this disclosure will become apparent upon reading the following detailed description and upon reference to the accompanying drawings. The description and the associated drawings are provided to illustrate embodiments of the invention and not limited to the scope of the invention.

DETAILED DESCRIPTION

A printhead mechanism in one embodiment of the present application includes a thermal head supported while being pressed to an object that moves in a predetermined object-conveyance direction, a pressing part pressing the thermal head in a direction orthogonal to the object-conveyance direction, and a supporting part supporting the thermal head movably in the head-pressing direction, wherein an acting point of pressing force at which the thermal head is pressed is disposed downstream of a supporting point at which the thermal head is supported.

According to one embodiment of the present application, an adequate printing pressure can be obtained.

Figure 1:
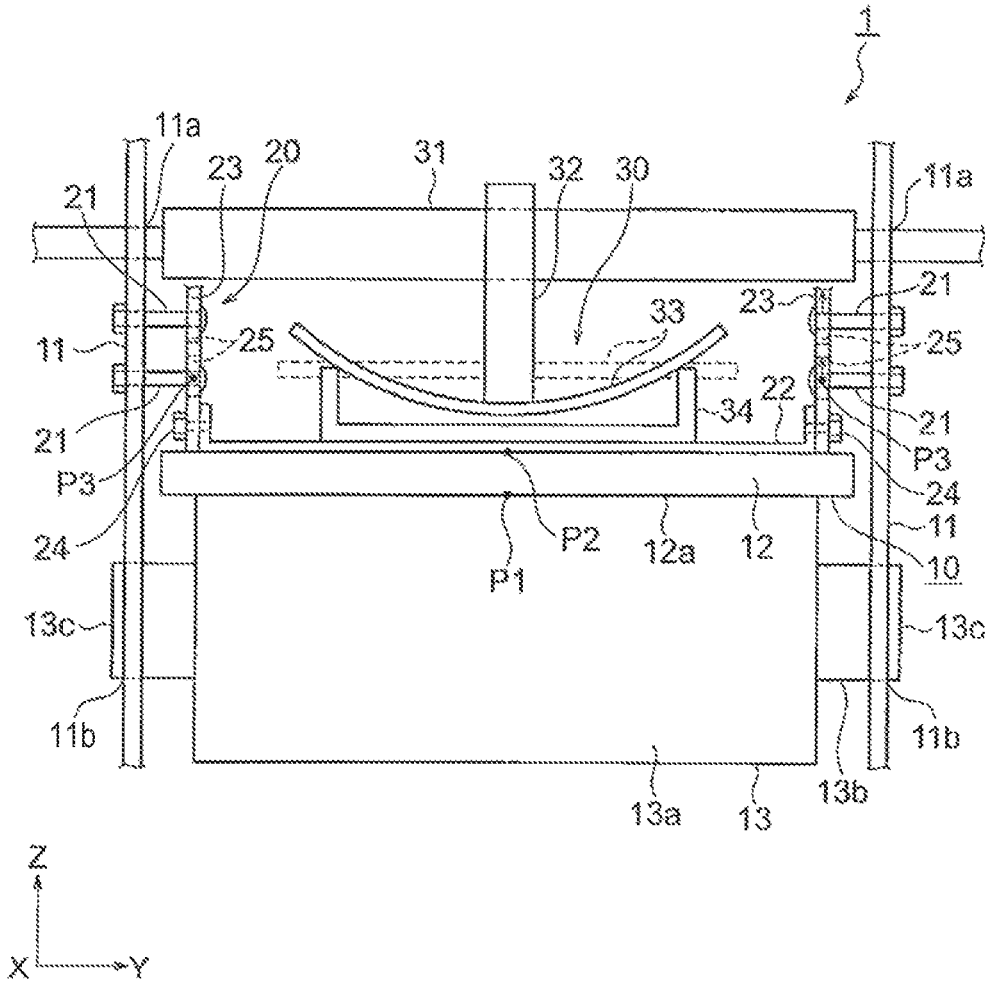
FIG. 1 is a front view showing a configuration of a printing device in an embodiment.
Figure 2:
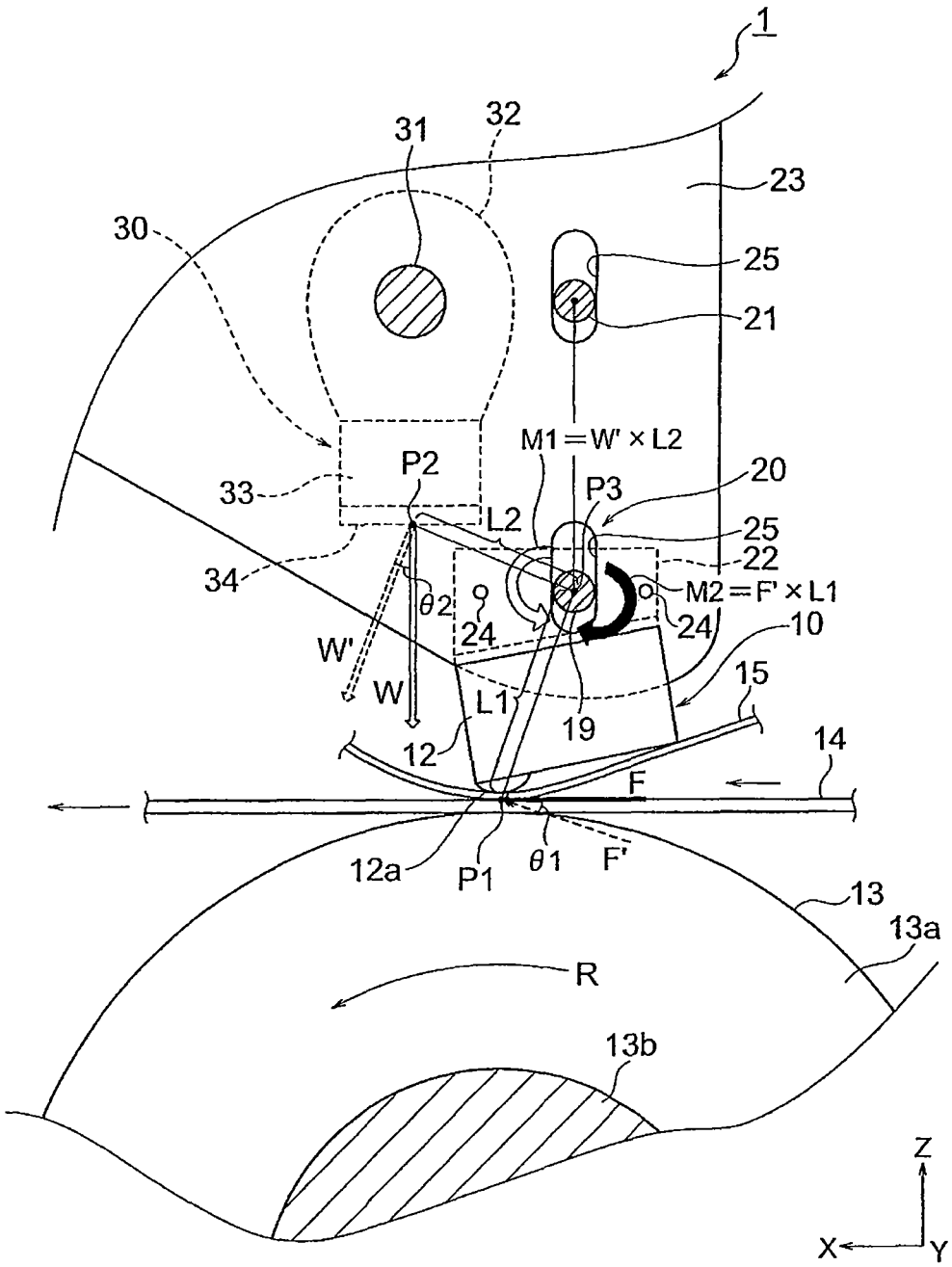
FIG. 2 is an illustrative diagram showing a configuration of the printing device of the embodiment.

Description will be made for the printing device in one embodiment in conjunction with FIGS. 1 and 2. In the figures, arrows X, Y, Z indicate axes in three directions, each direction being orthogonal to the other directions. Herein, the X-axis is defined in a paper-conveyance direction in a print part; the Y-axis is defined in the paper-width direction; and the Z-axis is defined in the direction in which the printhead presses onto a print paper. FIG. 1 is a front view showing a configuration of a printing device in this embodiment. FIG. 2 is an illustrative diagram showing a configuration of the printing device in this embodiment in its side view. For illustration, the figures are presented being enlarged, contracted, cut down, as needed.

A printing device 1 is, for example, a thermal printer used as a label printer, barcode printer, receipt printer, etc., which has a printhead mechanism 10. Printing device 1 includes a pair of side frames 11, a thermal head 12 (printhead) that is supported between the pair of side frames 11, a platen roller 13 opposed to thermal head 12, a printhead supporting mechanism 20 (support part) that slidably supports thermal head 12, and a pressing mechanism 30 (pressing part) that presses thermal head 12 onto platen roller 13.

A paper sheet 14 and an ink ribbon 15 are interposed between a heater line 12*a* of thermal head 12 and platen roller 13 at a print section P1, at which printing is performed with the ink ribbon 15 heated by heater line 12*a* as paper sheet 14 and ink ribbon 15 are conveyed in a predetermined paper-conveyance direction along the X-axis in the figure. For illustration, paper sheet 14 and ink ribbon 15 are omitted in FIG. 1.

A pair of side frames 11 each is provided at both ends in the paper-width direction along the Y-axis in the FIG. 1. There are mounted a plurality of supporting shaft members 21 on these pair of side frames 11. Supporting shaft members 21 are formed as poles that protrude from the both ends inwardly in the paper-width direction, and provided in pair movably along the Z-axis direction in the figure. That is, supporting shaft members 21 are provided so as to be able to move in the direction of pressing a platen shaft. Furthermore, in the pair of side frames 11 there are provided a support member 11*a* that rotatably supports a cam shaft 31 of head-pressing mechanism 30 and a support member 11*b* that rotatably supports the platen shaft of platen roller 13.

Thermal head 12 includes heater line 12*a* composed of multiplex heat elements arranged in a line in the paper-width direction having a predetermined length covering the width of paper sheet 14. Thermal head 12 is pressed onto platen roller 13 by head-pressing mechanism 30 in the head-pressing direction (z-axis direction) orthogonal to the paper-conveyance direction of paper sheet 14 with paper sheet 14 and ink ribbon 15 interposed between the thermal head and the platen roller 13. The head-pressing direction is along the diameter of platen roller 13. Thermal head 12 is supported by head support mechanism 20 so as to slidably move in the head-pressing direction.

Platen roller 13 is formed in a cylinder extending to the paper-width direction, which is composed of, for example, a cylindrical roller 13*a* of an elastic material such as NBR (nitrile rubber) and a platen shaft 13*b*. Platen roller 13 is rotatably supported by support member 11*b* of side frames 11 through a pair of shaft receiving parts 13*c*. Platen roller 13 is driven by a motor, not indicated, to rotate on a rotation shaft extending in the paper-width direction (Y direction).

Head support mechanism 20 is comprised of supporting shaft members 21, a head support frame 22 that is fixed to the upper surface of thermal head 12 and a pair of head support plates 23, each of which is fixed to each of the ends in the width direction of head support frame 22.

Head support frame 22 is composed of, for example, a metal plate formed bent in a shape of a one-end open rectangular in its front view, each end of which is fixed to the paired head support plates 23 by a fixing member 24 such as a screw.

Paired head support plates 23, which, for example, are each composed of a flat metal plate, each have two slots 25 provided in parallel in the head-pressing direction. The plural slots 25 are shaped in an ellipse, the length of which is oriented in the head-pressing direction. Supporting shaft members 21 of side frames 11 are engaged with the slots 25 so as to move relatively in the head-pressing direction. Accordingly, thermal head 12 is supported by head support mechanism 20 allowing its movement in the head-pressing direction relative to the side frames 11.

Pressing mechanism 30 is comprised of a cam shaft 31 extending in the paper-width direction, a cam 32 provided in the middle part of cam shaft 31 in the paper-width direction, a press-spring 33 provided so as to contact with the lower part of cam 32, and a transmission frame 34 that transmits a pressing force W between this press-spring 33 and head support frame 22 of head support mechanism 20.

Cam shaft 31 is rotatably supported on support member 11 a of side frames 11 through the pair of both ends shaft receiving part. Cam 32 is composed of a noncircular plate, of which distance from cam shaft 31 to the peripheral varies, and serves to press press-spring 33 downwardly as cam shaft 31 rotates. Press-spring 33, which is composed of, for example, a resiliently deformable leaf spring, deforms by being pressed by cam 32, pressing transmission frame 34 downwardly by the load caused by the deformation. Transmission frame 34, which is formed by an one-open ended rectangular plate member viewed from its front, presses head support frame 22 downwardly averaging the pressing force W from cam 32. Thermal head 12 is pressed downwardly by thus configured pressing mechanism 30 through head support frame 22 in the head-pressing direction against paper sheet 14 (or ink ribbon 15).

Referring to FIG. 2, with a motor (not indicated) rotating in printing device 1, platen roller 13 rotates in the R direction. By the rotation of the platen roller 13, paper sheet 14 and ink ribbon 15 are conveyed in the sheet-convey direction along the X-axis, as indicated by the arrows in the figure, while contacting with thermal head 12 at print section P1. At this time, ink ribbon 15 is heated by thermal head 12, and print is made on paper sheet 14 interposed between the printhead and platen roller 13.

In printing device 1, there arises a pressing force W by pressing mechanism 30 that presses thermal head 12 in the head-pressing direction downwardly in the figure. There also arises a frictional force F at print section P1 in the paper-conveyance direction along the X-axis by thermal head 12 and the conveyance of ink ribbon 15 or paper sheet 14. Based on a support point P3 at which thermal head 12 is supported by head support mechanism 20, there are produced a second rotational moment M2, by friction force F, that acts clockwise in the figure, and a first rotational moment M1, by pressing force W, that acts counterclockwise in the figure.

A pressing-force acting point P2 at which pressing force W is exerted to thermal head 12 is provided downstream of a supporting point p3, at which the thermal head is supported, in the paper-conveyance direction. That is, for example, as illustrated in FIG. 2, press-spring 33 is provided downstream (left side in FIG. 2) of the center of lower supporting shaft member 21 in the paper-conveyance direction in the side view of FIG. 2. Therefore, based on supporting point p3 at which thermal head 12 is supported by head support mechanism 20, first rotational moment M1 and second rotational moment M2 are configured to act against each other thereby to get cancelled by each other.

Furthermore, in printing device 1, the arrangement of head support mechanism 20, pressing mechanism 30, and print section P1 are set so that first rotational moment 141 produced by pressing force W and second rotational moment M2 produced by frictional force F between the printhead and, ink ribbon 15 or paper sheet 14 are cancelled by each other.

For example, in the example of FIG. 2, assuming the center of lower supporting shaft members 21 closer to print section P1 as supporting point P3, the center of the lower face of press-spring 33 in its width direction as pressing-force acting point P2, and the contact point of thermal head 12 with paper sheet 14 or ink ribbon 15 as print section P1, the setting is made such that: a ratio of M1/M2 of first rotational moment M1 to second rotational moment M2 is within a range of some 0.7 to 1.3, where first rotational moment M1 is produced by multiplying a distance L1 from supporting point p3 to pressing-force acting point P2 by a component W' of pressing force W, which acts relative to pressing-force acting point P2, in a direction orthogonal to the linear line connecting supporting point p3 and pressing-force acting point P2; second rotational moment M2 is produced by multiplying a distance L2 from supporting point p3 to print section P1 (friction-force generating point) by a component F' of frictional force F in a direction orthogonal to the linear line connecting supporting point p3 and print section P1. That is, the arrangement is set to meet an expression 1 below.

$$0.7 \leqq M1/M2 \leqq 1.3 \qquad \text{Expression 1}$$

$$M1=(F' \times L1) \qquad \text{Expression 2}$$

$$M2=(W' \times L2) \qquad \text{Expression 3}$$

$$F'=\mu W \cos \theta 1 \qquad \text{Expression 4}$$

$$W'=W \cos \theta 2 \qquad \text{Expression 5}$$

where, θ1 denotes an angle subtended between the paper-conveyance direction and the line (dashed line) passing through print section P1 perpendicular to the line connecting supporting point p3 with print section P1, while θ2 denotes an angle subtended between the head pressing-direction and the line (arrowed dashed line) passing through pressing-force acting point P2 perpendicular to the line connecting supporting point p3 with pressing-force acting point P2, and μ denotes a dynamic friction coefficient between thermal head 12 and paper sheet 14 (ink ribbon 15).

According to the configuration described above, when platen roller 13 rotates in a state that thermal head 12 is pressed onto paper sheet 14 (or ink ribbon 15) with pressing force W exerted by press-spring 33, first rotational moment M1 derived from press-spring 33 that presses thermal head 12 to paper sheet 14 (or ink ribbon 15) and second rotational moment M2 derived from frictional force F that thermal head 12 receives by the sliding with paper sheet 14 (or ink ribbon 15) are mutually cancelled. Thus, the drag against pressing force W can be alleviated, and hence good printing pressure can be attained.

It is more preferable that first rotational moment M1 is set to be equal to second rotational moment M2 as meeting the expression below.

$$M1=M2 \qquad \text{Expression 6}$$

With this setting made, first rotational moment M1 can be balanced with second rotational moment M2 so that the two moments are mutually cancelled. Thus, the drag attributed to pressing force W can be eliminated and more suitable print pressure can be attained.

According to printing device 1 of the above-mentioned embodiment, a suitable print pressure can be easily attained only by adjusting the positions of head support mechanism 20, pressing mechanism 30, and print section P1. That is, since the setting is made so that pressing-force acting point P2 is positioned downstream of supporting point p3 in the paper-conveyance direction and first rotational moment M1 is balanced with second rotational moment M2, frictional force F between supporting shaft members 21 and slots 25 at supporting point p3 becomes reduced and hence the drag against pressing force W can be reduced. Consequently, the loss of pressing force W can be reduced or eliminated, and thus, a stable pressure can be provided. Accordingly, even when printing conditions by the nature of paper sheet 14 or environmental conditions are changed, stable printing can be performed.

Since the setting value of pressing force W can be lowered compared with the value given in the case that the drag occurred by the rotational moments, the energy required for the sheet conveyance can be reduced and hence a stable print pitch between pixels can be achieved. Moreover, since there is no need for setting a large value of pressing force W, adverse effects, such as cocking on ink ribbon 15, that are caused by application of an excess pressure onto an ink ribbon or else can be prevented. Thus, the print quality can be improved.

In the above embodiment expressions 1 to 6 are used. However, for example, conditional settings for the reference positions P1 to P3 as the references, the magnitudes or directions of forces F' and W' may be appropriately altered as needed depending upon various conditions of configurations or arrangements of printing devices or paper sheet 14.

In the above embodiment, pressing mechanism 30 was exemplified by the configuration using cam 32 and press-spring 33. However, other type of a pressing mechanism, e.g., a coil spring expandable by a magnitude of a load can be used. Furthermore, an example for head support mechanism 20 was shown by supporting by the engagement of supporting shaft members 21 in plural slots 25. However, the mechanism need not be restricted to this. Head support mechanisms with different configurations, e.g., a structure having mutually slidable rails can be employed.

In the above embodiment, an example was shown in which ink ribbon 15 as the object is provided between thermal head 12 and paper sheet 14. In place of this example, a thermosensitive recording paper having a thermal sensitive layer developing color by heat can be used as the object instead of an ink ribbon.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printhead mechanism, comprising:

a thermal head supported by a supporting part at a supporting point and pressed to an object that moves in a predetermined object-conveyance direction; and a pressing part pressing the thermal head in a head-pressinq direction orthogonal to the object-conveyance direction;

the supporting part supporting the thermal head slidably in the head-pressing direction and an acting point of pressing force at which the thermal head is pressed being positioned downstream of the supporting point in the object-conveyance direction.

2. The printhead mechanism according to claim 1, wherein the printhead mechanism is configured so that a first rotational moment and a second rotational moment act in respective directions in which the two rotational moments are substantially mutually cancelled, the first rotational moment being produced by a friction force between the thermal head and the object, the second rotational moment being produced by the pressing force, based on a supporting point at which the thermal head is supported by the supporting part.

3. The printhead mechanism according to claim 2, wherein a ratio of the first rotational moment to the second rotational moment is within a range of 0.7 to 1.3.

4. The printhead mechanism according to claim 2, wherein the printhead mechanism is configured so that the first rotational moment becomes equal to the second rotational moment.

5. The printhead mechanism according to claim 1, wherein the object is an ink ribbon provided between a paper sheet and the thermal head.

6. The printhead mechanism according to claim 1, wherein the object is a thermosensitive recording paper.

7. A printing device, comprising:

a thermal head supported by a supporting part at a supporting point and pressed to an object that moves in a predetermined object-conveyance direction;

a pressing part pressing the thermal head in a head-pressing direction orthogonal to the object-conveyance direction;

the supporting part supporting the thermal head movably in the head-pressing direction and an acting point of pressing force pressing the thermal head being positioned downstream of the supporting point in the object-conveyance direction, the supporting part having a plurality of slots whose lengths are oriented in the head-pressing direction;

a platen provided in a position opposed to the thermal head; and shaft members each slidably engaging in each of the slots.

8. The printing device according to claim 7, wherein the printhead mechanism is configured so that a first rotational moment and a second rotational moment act in respective directions in which the two rotational moments are substantially mutually cancelled, the first rotational moment being produced by a friction force between the object and the thermal head, the second rotational moment being produced by the head-pressing force, based on a supporting point at which the thermal head is supported by the supporting part.

9. The printing device according to claim 8, wherein a ratio of the first rotational moment to the second rotational moment is within a range of 0.7 to 1.3.

10. The printing device according to claim 8, wherein the printhead mechanism is configured so that the first rotational moment becomes equal to the second rotational moment.

11. The printing device according to claim 7, wherein the object is an ink ribbon provided between a paper sheet and the thermal head.

12. The printing device according to claim 7, wherein the object is a thermosensitive recording paper.

13. The method of supporting a thermal head, comprising:

supporting the thermal head at a supporting point, the thermal head being slidably moveable in a head-pressing direction;

generating, in the head-pressing direction, a head-pressing force that presses the thermal head toward an object that is conveyed in a predetermined direction, so that an acting point of the head-pressing force at which the thermal head is pressed is positioned downstream of the supporting point in the predetermined direction; and generating a first rotational moment produced by friction between the object being conveyed and the thermal head; wherein a second rotational moment produced by the head-pressing force acts in such a direction that the first rotational moment is caused to be substantially cancelled.

14. The method according to claim 13, wherein a ratio of the first rotational moment to the second rotational moment is within a range of 0.7 to 1.3.

15. The method according to claim 13, wherein the first rotational moment becomes equal to the second rotational moment.

16. The method according to claim 13, wherein the object is an ink ribbon provided between a paper sheet and the thermal head.

17. The method according to claim 13, wherein the object is a thermosensitive recording paper.

* * * * *